US008374855B2

(12) United States Patent
Hetherington et al.

(10) Patent No.: US 8,374,855 B2
(45) **Date of Patent: *Feb. 12, 2013**

(54) SYSTEM FOR SUPPRESSING RAIN NOISE

(75) Inventors: Phillip A. Hetherington, Port Moody (CA); Adrian R. Groves, Surrey (CA)

(73) Assignee: QNX Software Systems Limited, Kanata, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/111,274

(22) Filed: May 19, 2011

(65) Prior Publication Data

US 2011/0282660 A1 Nov. 17, 2011

Related U.S. Application Data

(63) Continuation of application No. 11/006,935, filed on Dec. 8, 2004, now Pat. No. 7,949,522, which is a continuation-in-part of application No. 10/688,802, filed on Oct. 16, 2003, now Pat. No. 7,895,036, which is a continuation-in-part of application No. 10/410,736, filed on Apr. 10, 2003, now Pat. No. 7,885,420.

(60) Provisional application No. 60/449,511, filed on Feb. 21, 2003.

(51) Int. Cl.
*G10L 21/02* (2006.01)

(52) U.S. Cl. ..... 704/226

(58) Field of Classification Search ..... 704/226
See application file for complete search history.

(56) References Cited

U.S. PATENT DOCUMENTS

| | | | |
|---|---|---|---|
| 4,486,900 | A | 12/1984 | Cox et al. |
| 4,531,228 | A | 7/1985 | Noso et al. |
| 4,630,304 | A | 12/1986 | Borth et al. |
| 4,630,305 | A | 12/1986 | Borth et al. |
| 4,811,404 | A | 3/1989 | Vilmur et al. |
| 4,843,562 | A | 6/1989 | Kenyon et al. |
| 4,845,466 | A | 7/1989 | Hariton et al. |
| 4,959,865 | A | 9/1990 | Stettiner et al. |
| 5,012,519 | A | 4/1991 | Adlersberg et al. |
| 5,027,410 | A | 6/1991 | Williamson et al. |
| 5,056,150 | A | 10/1991 | Yu et al. |
| 5,140,541 | A | 8/1992 | Sakata et al. |
| 5,146,539 | A | 9/1992 | Doddington et al. |
| 5,251,263 | A | 10/1993 | Andrea et al. |
| 5,313,555 | A | 5/1994 | Kamiya |
| 5,400,409 | A | 3/1995 | Linhard |
| 5,426,703 | A | 6/1995 | Hamabe et al. |
| 5,426,704 | A | 6/1995 | Tamamura et al. |
| 5,442,712 | A | 8/1995 | Kawamura et al. |
| 5,479,517 | A | 12/1995 | Linhard |

(Continued)

FOREIGN PATENT DOCUMENTS

| | | |
|---|---|---|
| CA | 2158847 | 9/1994 |
| CA | 2157496 | 10/1994 |

(Continued)

OTHER PUBLICATIONS

Pellom et al, "An improved . . . Constrained Iterative Speech Enhancement for Colored Noise Environments", IEEE Transactions on Speech and Audio Processing; vol. 6, Iss. 6, Nov. 1998, pp. 573-579.*

(Continued)

*Primary Examiner* — Michael N Opsasnick
(74) *Attorney, Agent, or Firm* — Brinks Hofer Gilson & Lione

(57) ABSTRACT

A voice enhancement logic improves the perceptual quality of a processed signal. The voice enhancement system includes a noise detector and a noise attenuator. The noise detector detects and models the noise associated with rain. The noise attenuator dampens or reduces the rain noise from a signal to improve the intelligibility of an unvoiced, a fully voiced, or a mixed voice segment.

19 Claims, 16 Drawing Sheets

U.S. PATENT DOCUMENTS 5,485,522 A 1/1996 Sölve et al.
5,495,415 A 2/1996 Ribbens et al.
5,502,688 A 3/1996 Recchione et al.
5,526,466 A 6/1996 Takizawa
5,550,924 A 8/1996 Helf et al.
5,568,559 A 10/1996 Makino
5,574,824 A 11/1996 Slyh et al.
5,584,295 A 12/1996 Muller et al.
5,586,028 A 12/1996 Sekine et al.
5,617,508 A 4/1997 Reaves
5,651,071 A 7/1997 Lindemann et al.
5,677,987 A 10/1997 Seki et al.
5,680,508 A 10/1997 Liu
5,692,104 A 11/1997 Chow et al.
5,701,344 A 12/1997 Wakui
5,708,754 A 1/1998 Wynn
5,727,072 A 3/1998 Raman
5,752,226 A 5/1998 Chan et al.
5,809,152 A 9/1998 Nakamura et al.
5,839,101 A 11/1998 Vahatalo et al.
5,859,420 A 1/1999 Borza
5,878,389 A 3/1999 Hermansky et al.
5,920,834 A 7/1999 Sih et al.
5,933,495 A 8/1999 Oh
5,933,801 A 8/1999 Fink et al.
5,949,888 A 9/1999 Gupta et al.
5,982,901 A 11/1999 Kane et al.
6,011,853 A 1/2000 Koski et al.
6,108,610 A 8/2000 Winn
6,122,384 A 9/2000 Mauro
6,122,610 A 9/2000 Isabelle
6,130,949 A 10/2000 Aoki et al.
6,163,608 A 12/2000 Romesburg et al.
6,167,375 A 12/2000 Miseki et al.
6,173,074 B1 1/2001 Russo
6,175,602 B1 1/2001 Gustafsson et al.
6,192,134 B1 2/2001 White et al.
6,199,035 B1 3/2001 Lakaniemi et al.
6,208,268 B1 3/2001 Scarzello et al.
6,230,123 B1 5/2001 Mekuria et al.
6,252,969 B1 6/2001 Ando
6,289,309 B1 9/2001 deVries
6,405,168 B1 6/2002 Bayya et al.
6,415,253 B1 7/2002 Johnson
6,434,246 B1 8/2002 Kates et al.
6,449,594 B1 9/2002 Hwang et al.
6,453,285 B1 9/2002 Anderson et al.
6,507,814 B1 1/2003 Gao
6,510,408 B1 1/2003 Hermansen
6,587,816 B1 7/2003 Chazan et al.
6,615,170 B1 9/2003 Liu et al.
6,643,619 B1 11/2003 Linhard et al.
6,647,365 B1 11/2003 Faller
6,687,669 B1 2/2004 Schrögmeier et al.
6,711,536 B2 3/2004 Rees
6,741,873 B1 5/2004 Doran et al.
6,766,292 B1 7/2004 Chandran et al.
6,768,979 B1 7/2004 Menendez-Pidal et al.
6,782,363 B2 8/2004 Lee et al.
6,822,507 B2 11/2004 Buchele
6,859,420 B1 2/2005 Coney et al.
6,882,736 B2 4/2005 Dickel et al.
6,910,011 B1 6/2005 Zakarauskas
6,937,980 B2 * 8/2005 Krasny et al. ..... 704/231
6,959,276 B2 10/2005 Droppo et al.
7,043,030 B1 5/2006 Furuta
7,047,047 B2 5/2006 Acero et al.
7,062,049 B1 6/2006 Inoue et al.
7,072,831 B1 7/2006 Etter
7,092,877 B2 8/2006 Ribic
7,117,145 B1 10/2006 Venkatesh et al.
7,117,149 B1 10/2006 Zakarauskas
7,139,701 B2 11/2006 Harton et al.
7,158,932 B1 1/2007 Furata
7,165,027 B2 * 1/2007 Kellner et al. ..... 704/233
7,313,518 B2 12/2007 Scalart et al.
7,373,296 B2 5/2008 Van De Par et al.
7,386,217 B2 6/2008 Zhang
2001/0028713 A1 10/2001 Walker
2002/0037088 A1 3/2002 Dickel et al.
2002/0071573 A1 6/2002 Finn
2002/0094100 A1 7/2002 Kates et al.
2002/0094101 A1 7/2002 DeRoo et al.
2002/0152066 A1 10/2002 Piket
2002/0176589 A1 11/2002 Buck et al.
2002/0193130 A1 12/2002 Yang et al.
2003/0040908 A1 * 2/2003 Yang et al. ..... 704/233
2003/0115055 A1 6/2003 Gong
2003/0147538 A1 8/2003 Elko
2003/0151454 A1 8/2003 Buchele
2003/0216907 A1 11/2003 Thomas
2004/0019417 A1 1/2004 Yasui et al.
2004/0078200 A1 4/2004 Alves
2004/0093181 A1 5/2004 Lee
2004/0138882 A1 7/2004 Miyazawa
2004/0161120 A1 8/2004 Petersen et al.
2004/0165736 A1 8/2004 Hetherington et al.
2004/0167777 A1 8/2004 Hetherington et al.
2005/0238283 A1 10/2005 Faure et al.
2005/0240401 A1 10/2005 Ebenezer
2006/0034447 A1 2/2006 Alves et al.
2006/0074646 A1 4/2006 Alves et al.
2006/0100868 A1 5/2006 Hetherington et al.
2006/0115095 A1 6/2006 Giesbrecht et al.
2006/0116873 A1 6/2006 Hetherington et al.
2006/0136199 A1 6/2006 Nongpiur et al.
2006/0251268 A1 11/2006 Hetherington et al.
2006/0287859 A1 12/2006 Hetherington et al.
2007/0019835 A1 1/2007 Ivo de Roo et al.
2007/0033031 A1 2/2007 Zakarauskas

FOREIGN PATENT DOCUMENTS

CA 2158064 10/1994
CN 1325222 A 12/2001
EP 0 076 687 A1 4/1983
EP 0 629 996 A2 12/1994
EP 0 629 996 A3 12/1994
EP 0 750 291 A1 12/1996
EP 1 450 353 A1 2/2004
EP 1 450 354 A1 2/2004
EP 1 669 983 A1 6/2006
JP 64-039195 2/1989
JP 06269084 9/1994
JP 6282297 10/1994
JP 06319193 11/1994
JP 6349208 12/1994
JP 2001215992 8/2001
WO WO 00-41169 A1 7/2000
WO WO 0156255 A1 8/2001
WO WO 01-73761 A1 10/2001

OTHER PUBLICATIONS

Avendano, C., Hermansky, H., "Study on the Dereverberation of Speech Based on Temporal Envelope Filtering," Proc. ICSLP '96, pp. 889-892, Oct. 1996.

Berk et al., "Data Analysis with Microsoft Excel," Duxbury Press, 1998, pp. 236-239 and 256-259.

Boll, "Suppression of Acoustic Noise in Speech Using Spectral Subtraction", IEEE Trans. on Acoustics, Speech, and Signal Processing, Apr. 1979, pp. 113-120.

Ephraim, Y., "Statistical-Model-Based Speech Enhancement Systems," IEEE, vol. 80, No. 10, 1992, pp. 1526-1555.

Fiori, S., Uncini, A., and Piazza, F., "Blind Deconvolution by Modified Bussgang Algorithm", Dept. of Electronics and Automatics—University of Ancona (Italy), ISCAS 1999.

Godsill, S. et al., "Digital Audio Restoration," Department of Engineering, University of Cambridge, 1997, pp. 1-71.

Learned, R.E. et al., A Wavelet Packet Approach to Transient Signal Classification, Applied and Computational Harmonic Analysis, Jul. 1995, pp, 265-278, vol. 2, No. 3, USA, XP 000972660. ISSN: 1063-5203. abstract.

Ljung, L., Chapter 1, "Introduction," *System Identification Theory for the User*, 2nd ed., Prentice Hall, Upper Saddle River, New Jersey, Copyright 1999, pp. 1-14.

Nakatani, T., Miyoshi, M., and Kinoshita, K., "Implementation and Effects of Single Channel Dereverberation Based on the Harmonic Structure of Speech," Proc. of IWAENC-2003, pp. 91-94, Sep. 2003.

Pellom, B.L. et al., "An Improved (Auto:I, LSP:T) constrained iterative speech enhancement for colored noise environments", Speech and Audio Processing, IEEE Transactions on vol. 6, Issue 6, Nov. 1998, pp. 573-579.

Puder, H. et al. "Improved Noise Reduction for Hands-Free Car Phones Utilizing Information on Vehicle and Engine Speeds", Finland Abstract, Tampere Univ. Technology, Tampere, Finland, Sep. 4-8, 2000, vol. 3, XP009030255, pp. 1851-1854.

Quatieri, T.F. et al., Noise Reduction Using a Soft-Dection/Decision Sine-Wave Vector Quantizer, International Conference on Acoustics, Speech & Signal Processing, Apr. 3, 1990, pp. 821-824, vol. Conf. 15, IEEE ICASSP, New York, US XP000146895, Abstract, Paragraph 3.1.

Quelavoine, R. et al., Transients Recognition in Underwater Acoustic with Multilayer Neural Networks, Engineering Benefits from Neural Networks, Proceedings of the International Conference EANN 1998, Gibraltar, Jun. 10-12, 1998 pp. 330-333, XP 000974500. 1998, Turku, Finland, Syst. Eng. Assoc., Finland. ISBN: 951-97868-0-5. abstract, p. 30 paragraph 1.

Seely, S., "An Introduction to Engineering Systems," Pergamon Press Inc., 1972, pp. 7-10.

Shust, Michael R. and Rogers, James C., Abstract of "Active Removal of Wind Noise From Outdoor Microphones Using Local Velocity Measurements", *J. Acoust. Soc. Am.*, vol. 104, No. 3, Pt 2, 1998, 1 page.

Shust, Michael R. and Rogers, James C., "Electronic Removal of Outdoor Microphone Wind Noise", obtained from the Internet on Jul. 28, 2004 at: <http://www.acounstics.org/press/136th/mshust.htm>, 6 pages.

Simon, G., Detection of Harmonic Burst Signals, International Journal Circuit Theory and Applications, Jul. 1985, vol. 13, No. 3, pp. 195-201, UK, XP 000974305. ISSN: 0098-9886. abstract.

Udrea, R. M. et al., "Speech Enhancement Using Spectral Over-Subtraction and Residual Noise Reduction," IEEE, 2003, pp. 165-168.

Vaseghi, "Advanced Digital Signal Processing and Noise Reduction", Publisher, John Wiley & Sons Ltd., 2000, pp. 1-28, 333-354, and 378-395.

Vaseghi, S.V., Chapter 12 "Impulsive Noise," *Advanced Digital Signal Processing and Noise Reduction*, 2nd ed., John Wiley and Sons, Copyright 2000, pp. 355-377.

Vieira, J., "Automatic Estimation of Reverberation Time", Audio Engineering Society, Convention Paper 6107, 116th Convention, May 8-11, 2004, Berlin, Germany, pp. 1-7.

Wahab A., et al. "Intelligent Dashboard With Speech Enhancement", Information, Communications and Signal Processing, 1997, ICICS, Proceedings of International Conference on Singapore Sep. 9-12, 1997, *IEEE*, pp. 993-997.

Zakarauskas, P., Detection and Localization of Nondeterministic Transients in Time series and Application to Ice-Cracking Sound, Digital Signal Processing, 1993, vol. 3, No. 1, pp. 36-45, Academic Press, Orlando, FL, USA, XP 000361270, ISSN: 1051-2004. entire document.

* cited by examiner

SYSTEM FOR SUPPRESSING RAIN NOISE

PRIORITY CLAIM

This application is a continuation of U.S. application Ser. No. 11/006,935 "System for Suppressing Rain Noise," filed Dec. 8, 2004 now U.S. Pat. No. 7,949,522, which is a continuation-in-part of U.S. application Ser. No. 10/688,802 "System for Suppressing Wind Noise," filed Oct. 16, 2003 now U.S. Pat. No. 7,895,036, which is a continuation-in-part of U.S. application Ser. No. 10/410,736, "Method and Apparatus for Suppressing Wind Noise," filed Apr. 10, 2003 now U.S. Pat. No. 7,885,420, which claims priority to U.S. Application No. 60/449,511 "Method for Suppressing Wind Noise" filed on Feb. 21, 2003. The disclosures of the above applications are incorporated herein by reference.

BACKGROUND OF THE INVENTION

1. Technical Field

This invention relates to acoustics, and more particularly, to a system that enhances the perceptual quality of sound by reducing interfering noise.

2. Related Art

Many hands-free communication devices acquire, assimilate, and transfer a voice signal. Voice signals pass from one system to another through a communication medium. In some systems, including those used in vehicles, the clarity of a voice signal does not depend on the quality of the communication system or the quality of the communication medium. When noise occurs near a source or a receiver, distortion may interfere with the voice signal, destroy information, and in some instances, masks the voice signal so that it cannot be recognized.

Noise may come from many sources. In a vehicle, noise may be created by the engine, the road, the tires, or by the surrounding environment. When rain falls onto a vehicle it produces noise that may be heard across a broad frequency spectrum. Some aspects of this noise are predictable, while others are random.

Some systems attempt to counteract the effects of rain noise by insulating vehicles with a variety of sound-suppressing and dampening materials. While these materials are effective in reducing some noises, the materials also absorb desired signals and do not block the rain noise that may mask a portion of the audio spectrum. Another problem with some speech enhancement systems is that of detecting rain noise. Yet another problem with some speech enhancement systems is that they do not easily adapt to other communication systems.

Therefore there is a need for a system that counteracts the noise associated with water striking a surface across a varying frequency range.

SUMMARY

This invention provides a voice enhancement logic that improves the perceptual quality of a processed voice. The system learns, encodes, and then dampens the noise associated with water striking a surface that includes the surface of a vehicle. The system includes a noise detector and a noise attenuator. The noise detector detects noise associated with falling water, such as the noise that may be heard during a rainstorm. The noise attenuator dampens or reduces some of the detected rain noise.

Alternative voice enhancement logic includes time frequency transform logic, a background noise estimator, a rain noise detector, and a rain noise attenuator. The time frequency transform logic converts a time varying input signal into a frequency domain output signal. The background noise estimator measures the continuous noise that may accompany the input signal. The rain noise detector automatically identifies and models some of the noise associated with rain, which is then dampened or reduced by the rain noise attenuator.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A voice enhancement logic improves the perceptual quality of a processed voice. The logic may automatically learn and encode the shape and form of the noise associated with rain in a real or a delayed time. By tracking selected attributes, the logic may substantially eliminate or dampen rain noise using a memory that temporarily stores the selected attributes of the noise. Alternatively, the logic may also dampen a continuous noise and/or the "musical noise," squeaks, squawks, chirps, clicks, drips, pops, tones, or other sound artifacts that may be generated by some voice enhancement systems.

Figure 1:
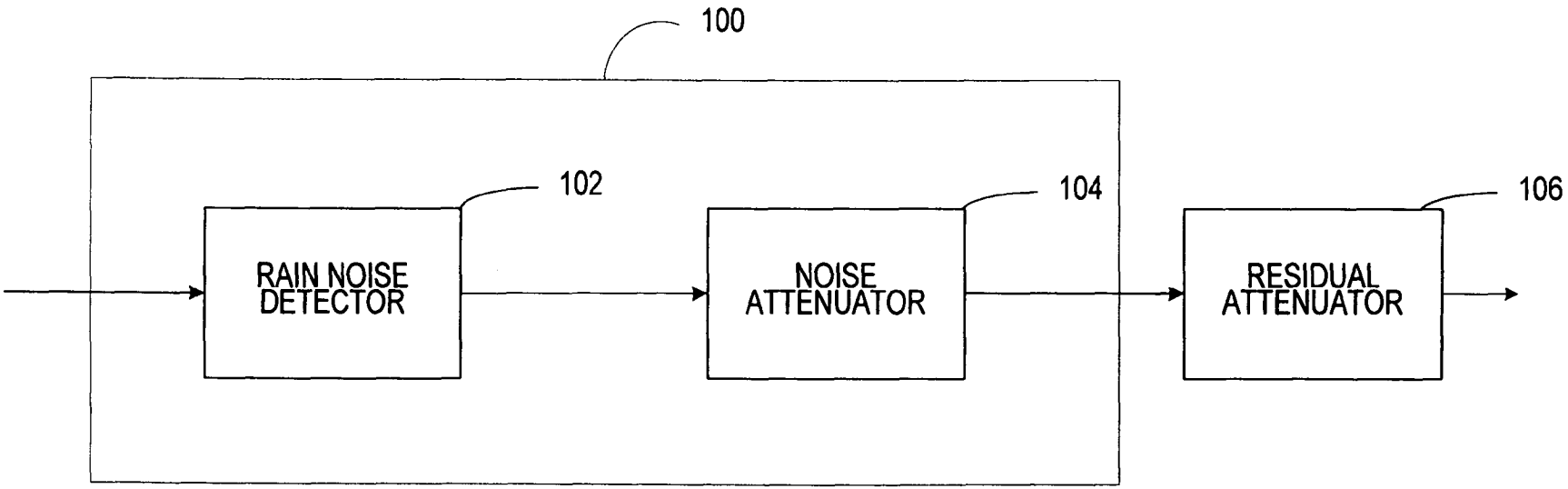
FIG. 1 is a partial block diagram of voice enhancement logic.

FIG. 1 is a partial block diagram of the voice enhancement logic 100. The voice enhancement logic 100 may encompass hardware or software that is capable of running on one or more processors in conjunction with one or more operating systems. The highly portable logic includes a rain noise detector 102 and a noise attenuator 104.

In FIG. 1 the rain noise detector 102 may identify and model a noise associated with rain that falls onto or strikes a surface. While rain noise may occur across a broad frequency spectrum, the rain noise detector 102 is configured to detect and model the rain noise that is perceived by the ear. The rain noise detector 102 receives incoming sound, that in the short term spectra, may be classified into three broad categories: (1) unvoiced, which exhibits noise-like characteristics that may include the noise associated with rain, e.g., it may have some spectral shape but no harmonic or formant structure; (2) fully voiced, which exhibits a regular harmonic structure, or peaks at pitch harmonics weighted by the spectral envelope that may describe the formant structure, and (3) mixed voice, which exhibits a mixture of the above two categories, some parts containing noise-like segments that may include rain noise, the rest exhibiting a regular harmonic structure and/or a formant structure.

The rain noise detector 102 may separate the noise-like segments from the remaining signal in a real or in a delayed time no matter how complex or how loud an incoming noise segment may be. The separated noise-like segments are analyzed to detect the occurrence of rain noise, and in some instances, the presence of a continuous underlying noise. When rain noise is detected, the spectrum is modeled, and the model is retained in a memory. While the rain noise detector 102 may store an entire model of a rain noise signal, it also may store selected attributes in a memory. Some selected attributes may model the noise created by rain striking a surface, the peripheral noise (e.g. in vehicle noise) that may be heard in a rainstorm, or a combination thereof.

To overcome the effects of rain noise, and in some instances, the underlying continuous noise that may include ambient noise, the noise attenuator 104 substantially removes or dampens the rain noise and/or the continuous noise from the unvoiced and mixed voice signals. The voice enhancement logic 100 encompasses any system that substantially removes, dampens, or reduces rain noise across a desired frequency spectrum. Examples of systems that may dampen or remove rain noise include systems that use a signal and a noise estimate such as (1) systems which use a neural network mapping of a noisy signal and an estimate of the noise to a noise-reduced signal, (2) systems that subtract the noise estimate from a noisy-signal, (3) systems that use the noisy signal and the noise estimate to select a noise-reduced signal from a code-book, (4) systems that in any other way use the noisy signal and the noise estimate to create a noise-reduced signal based on a reconstruction of the masked signal. These systems may attenuate rain noise, and in some instances, attenuate the continuous noise that may be part of the short-term spectra. The noise attenuator 104 may also interface or include an optional residual attenuator 106 that removes or dampens artifacts that may be introduced into the processed signal. The residual attenuator 106 may remove the "musical noise," squeaks, squawks, chirps, clicks, drips, pops, tones, or other sound artifacts.

Figure 2:
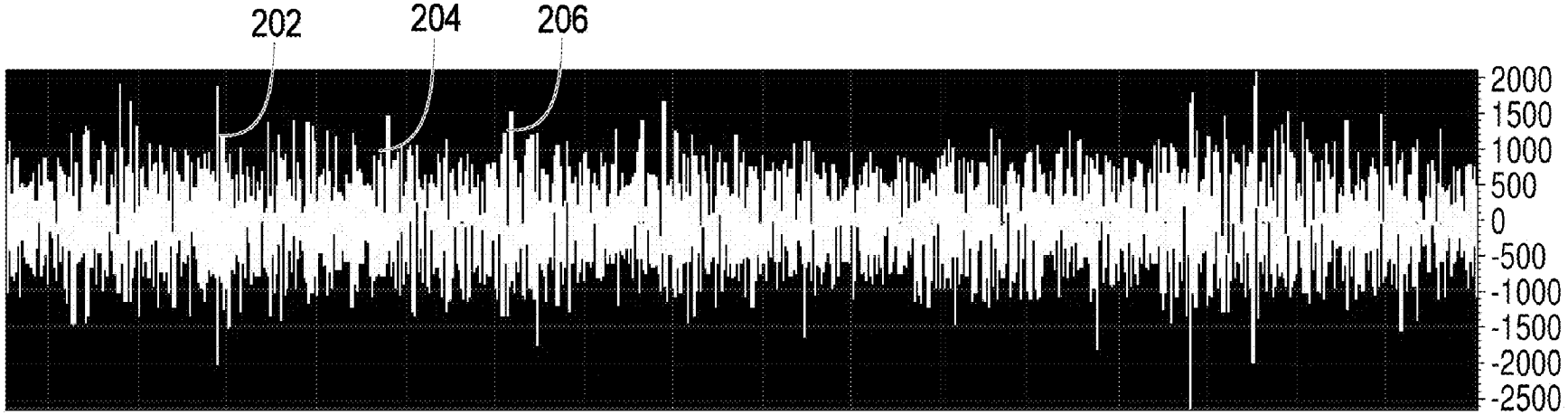
FIG. 2 is a time series plot of noise associated with rain and other sources.

FIG. 2 illustrates an exemplary frame of voice speech and a noisy signal created by water condensed from atmospheric vapor and falling in drops onto a surface. The rain pulses 202, 204, and 206 include the sound created by the rain striking a surface. The amplitudes of the rain pulses 202, 204, and 206 reflect the relative differences in power or intensity of rain striking a surface as detected by a receiver or a detector. In a vehicle, the rain pulses 202, 204, and 206 may represent the sound created when natural flowing water strikes a surface such as a window or the sound created when water conveyed under a pressure strikes a surface. The continuous noise shown in FIG. 2 may include an ambient noise, a noise associated with an engine, a noise created by a powertrain, a road noise, tire noise, other vehicle noises, or any other sounds.

Figure 3:
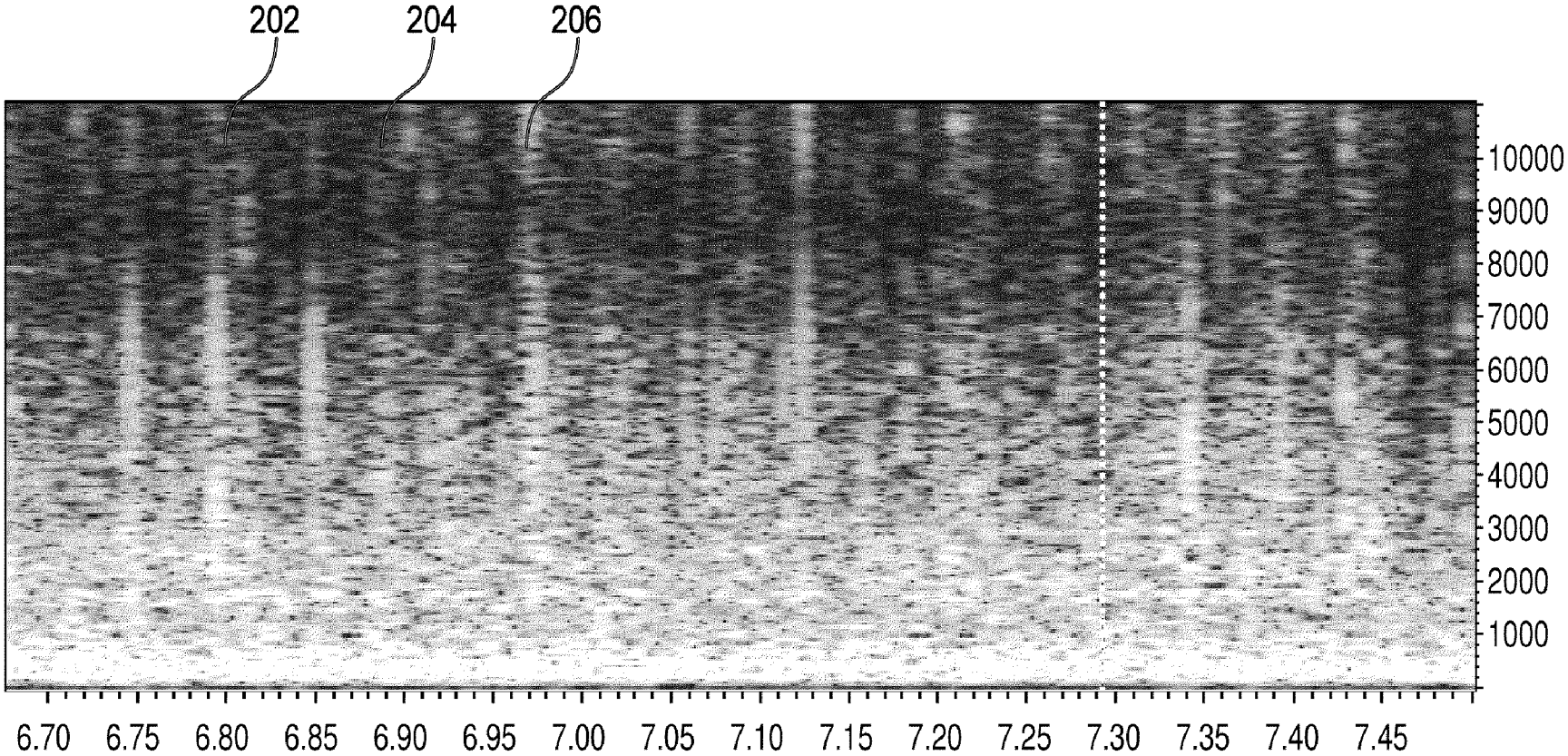
FIG. 3 is a is a time-frequency plot of noise associated with rain and other sources.

In the frequency spectral domain shown in FIG. 3, the continuous noise and rain pulses 202 204 and 206 may range from a substantially linear pulse to a curvilinear pulse. The substantially vertical lines of the raindrop transients shown in FIG. 3 may not be perfectly straight. Variances may be due to inherent distortion in the rain noise detector 102, the acoustics of the vehicle, and other sources. In some rain noise detectors 102 or the devices that may interface the rain noise detector 102, the circuits or hardware that converts sound waves into analog signals or convert the sound waves into digital data may distort the rain drop data. The shape of the rain drop transients may change as the signal is detected by or processed by such circuits. This distortion may result in loss of information. In some voice enhancement logic, the distortion may be learned and encoded allowing some of the noise attenuators 104 to substantially remove, dampen, or reduce the distortion.

Figure 4:
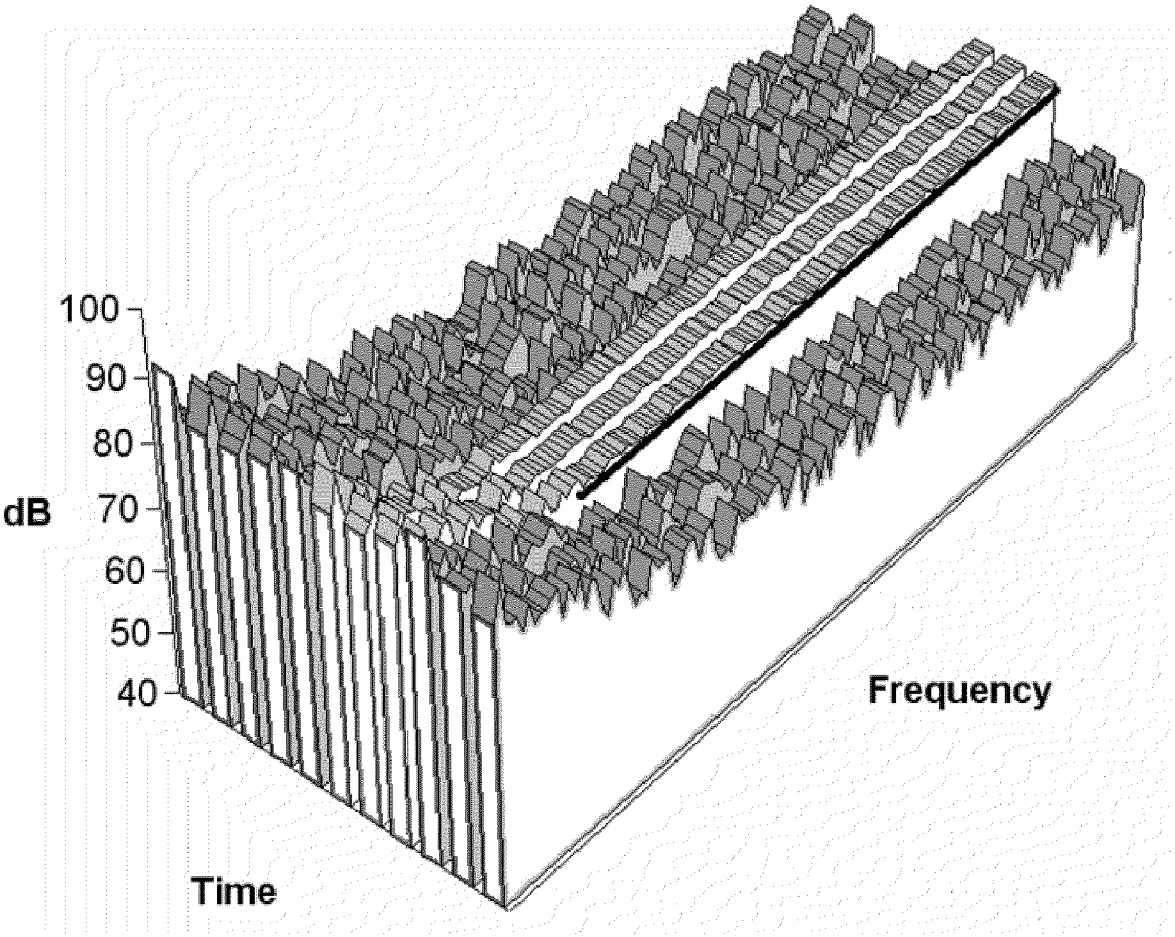
FIG. 4 is a waterfall plot of simulated noises of rain and other sources.

Rain drop detection may occur by monitoring segments of frequency forward and/or backward in time. Filter banks or Fast Fourier Transforms ("FFT") may transform sound into the log frequency domain. Through a comparison, the rain noise detector 102 identifies the frames that have substantially more energy than their adjacent frequency bands or frames. If a frequency band in a frame has higher energy than in an adjacent frame, the rain noise detector 102 looks for other frequency bands that also have more energy than in their neighboring frames. When the energy within these frequency bands can fit to a model such as straight line as shown in FIG. 4 or what may resemble a straight line, the rain noise detector 102 identifies the band as potential rain events. In some rain noise detectors 102 rain events may occur when the dispersion or variation of the energy relative to the line (e.g., the standard deviation) is within a predetermined or programmable range. Bands showing energy over neighbor but which are appreciably higher than the model may not be considered to be part of the rain drop noise.

Once the relative magnitudes and durations of the rain drop transients are learned, their removal may be accomplished by many methods. In one method, the noise attenuator 104 replaces the rain drop transient with an estimated value based on the values of adjacent frames. The interpolation method may occur with one or more frames positioned backward and/or forward in time and may impose predetermined restrictions and/or prior constraints. In an alternative method, the noise attenuator 104 adds the learned positions and frequencies to a known or measured constant noise estimate. The noise attenuator 104 then subtracts the noise estimate that includes the modeled rain noise from the noisy signal.

Figure 5:
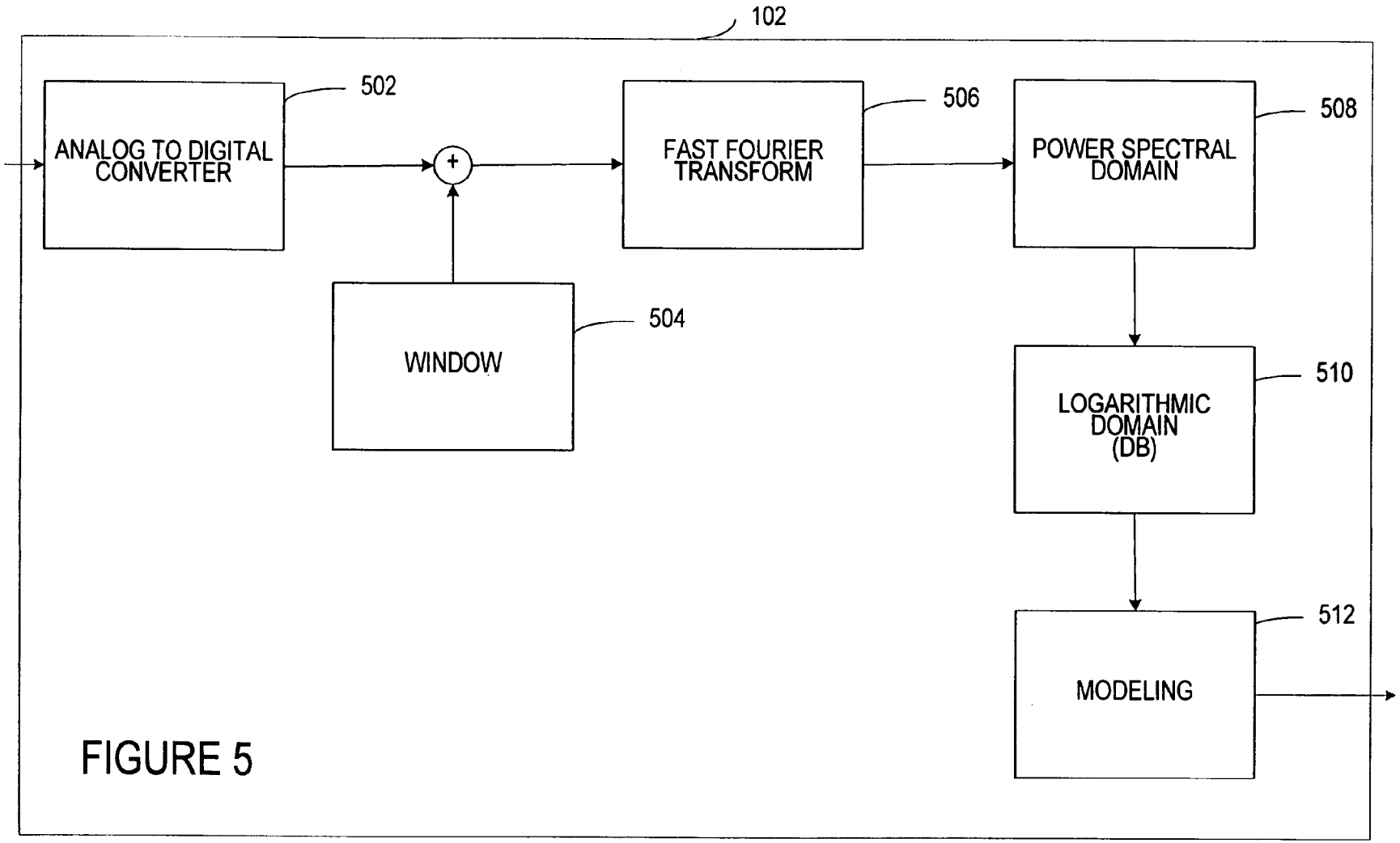
FIG. 5 is a block diagram of the voice enhancement logic of FIG. 1.

FIG. 5 is a block diagram of an example rain noise detector 102 that may receive or detect an unvoiced, fully voiced, or a mixed voice input signal. A received or detected signal is digitized at a predetermined frequency. To assure a good quality voice, the voice signal is converted to a pulse-code-modulated (PCM) signal by an analog-to-digital converter 502 (ADC) having any common sample rate. A smooth window 504 is applied to a block of data to obtain the windowed signal. The complex spectrum for the windowed signal may be obtained by means of a Fast Fourier Transform (FFT) 406 or a filter bank that separates the digitized signals into frequency bins, with each bin identifying an amplitude and phase across a small frequency range. Each frequency bin may then be converted into the power-spectral domain 508 and logarithmic domain 510 to develop a rain noise estimate with or without a continuous noise estimate. As more windows of sound are processed, the rain noise detector 102 may derive average rain noise estimates. A time-smoothed or weighted average may be used to estimate the rain noise with or without a continuous noise estimate for each frequency bin.

To detect a rain event, a line may be fitted to a selected portion of the frequency spectrum. Through a regression, a best-fit line may measure the severity of the rain noise within a given block of data. A high correlation between the best-fit line and the selected frequency spectrum may identify a rain noise event. Whether or not a high correlation exists, may depend on variations in frequency and amplitude of the rain noise and the presence of voice or other noises.

To limit a masking of voice, the fitting of the line to a suspected rain noise signal may be constrained by rules. Exemplary rules may prevent a calculated parametric description such as an offset, a slope, a curvature or a coordinate point in a rain noise model from exceeding an average value. Another rule may adjust or modulate the rain noise correction to prevent the noise attenuator 104 from applying a calculated rain noise correction when a vowel or another harmonic structure is detected. A harmonic may be identified by its narrow width and its sharp peak, or in conjunction with a voice or a pitch detector. If a vowel or another harmonic structure is detected, the rain noise detector 102 may limit the rain noise correction to values less than or equal to predetermined or average values. An additional rule may allow the average rain noise model or its attributes to be updated only during unvoiced segments. If a voiced or a mixed voice segment is detected, the average rain noise model or its attributes are not updated under this rule. If no voice is detected, the rain noise model or each attribute may be updated through any means, such as through a weighted average or a leaky integrator. Many other rules may also be applied to the model. The rules may provide a substantially good linear fit to a suspected rain noise event without masking a voice segment.

Figure 9:
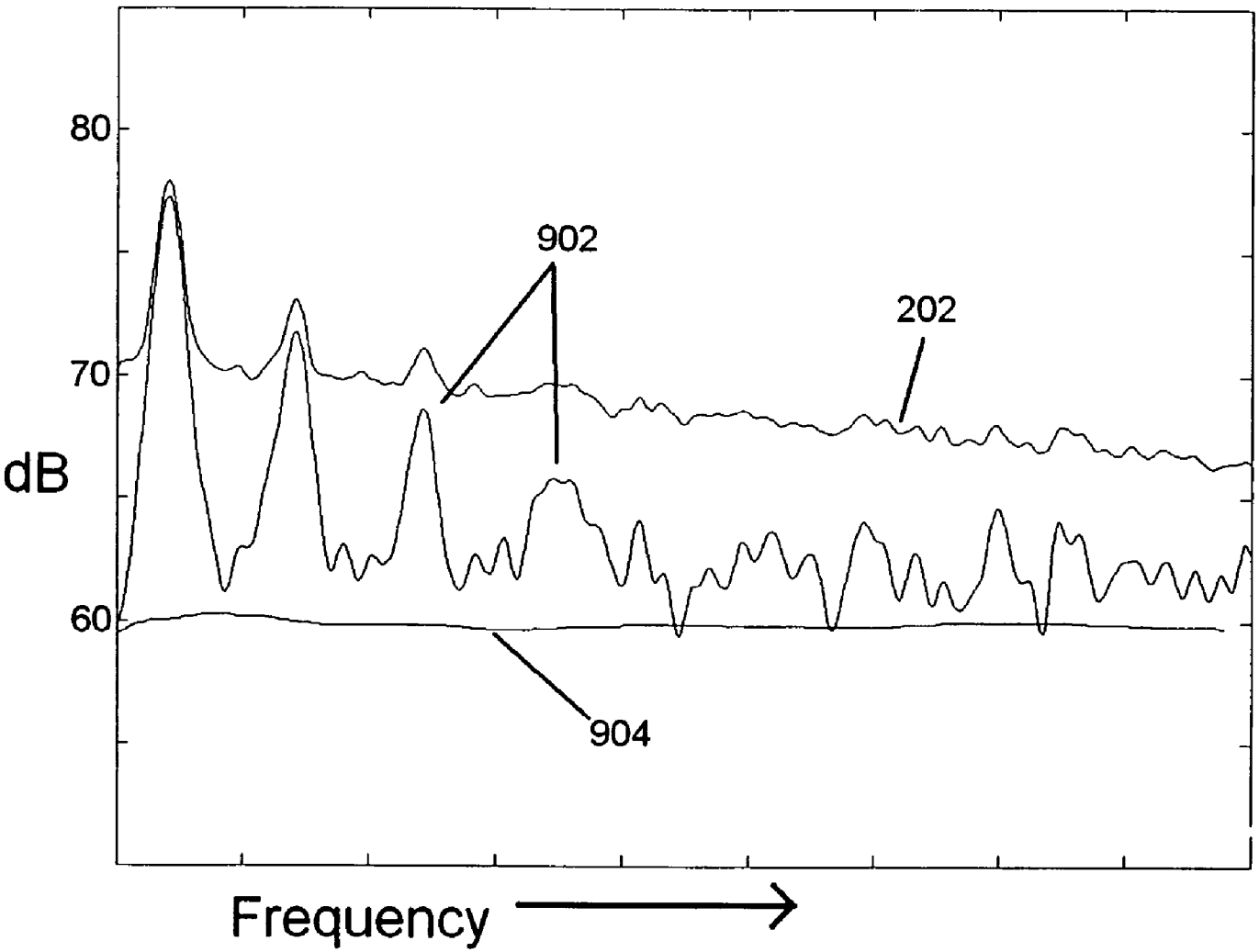
FIG. 9 is a graph of a rain noise masking a portion of a voice signal.
Figure 10:
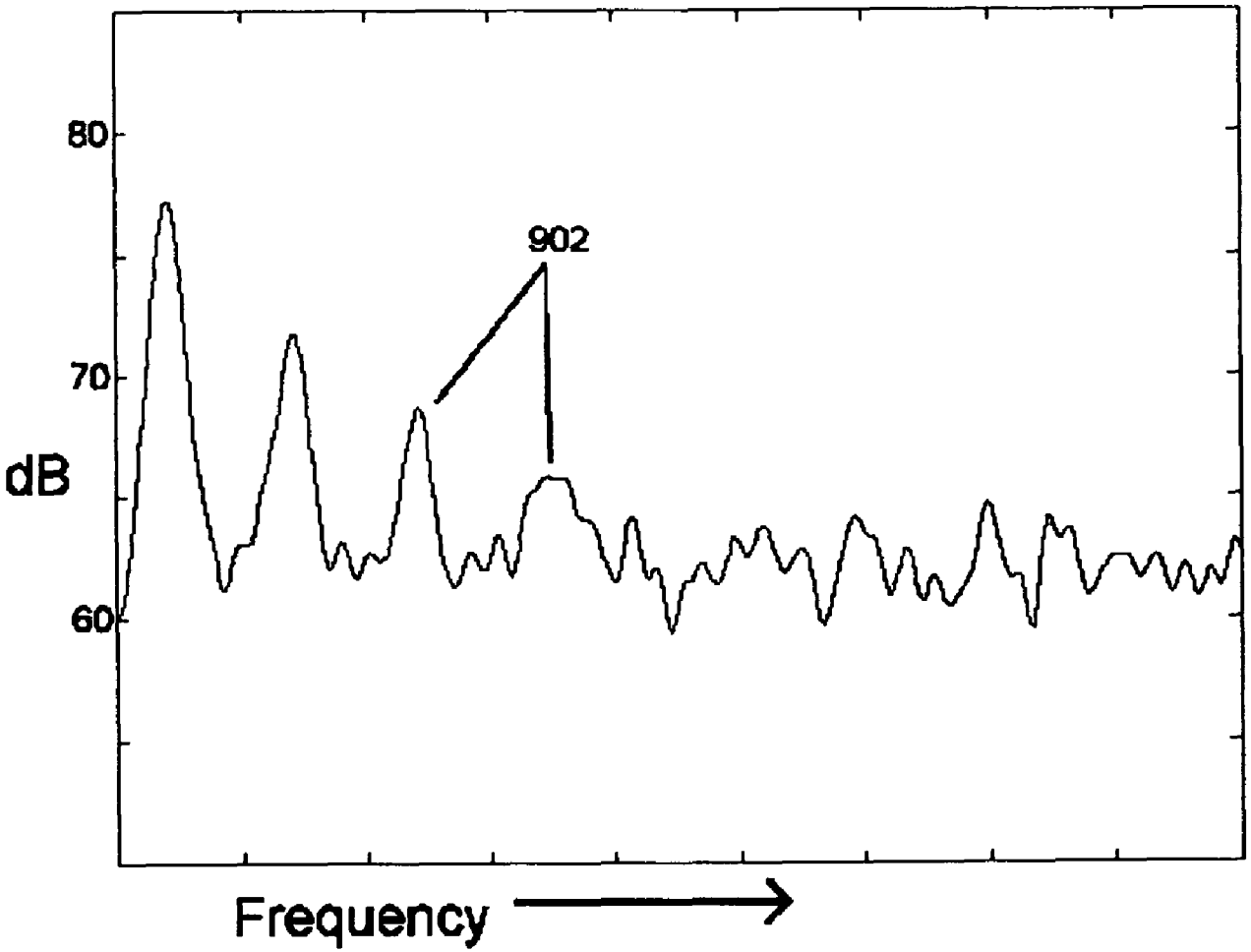
FIG. 10 is a graph of a processed and reconstructed voice signal.

To overcome the effects of rain noise, a rain noise attenuator 104 may substantially remove or dampen the rain noise from the noisy spectrum by any method. One method may add the rain noise model to a recorded or modeled continuous noise 904. In the power spectrum, the modeled noise may then be subtracted from the unmodified spectrum. If an underlying peak 902 or valley is masked by rain noise as shown in FIG. 9 or masked by a continuous noise, a conventional or modified interpolation method may be used to reconstruct the peak and/or valley as shown in FIG. 10. A linear or step-wise interpolator may be used to reconstruct the missing part of the signal. An inverse FFT, filter bank, may then be used to convert the signal power to the time domain, which provides a reconstructed voice signal. Alternatively, the signal may be transformed into another frequency transform such as Mel frequency cepstral coefficients.

To minimize the "music noise," squeaks, squawks, chirps, clicks, drips, pops, tone's, or other sound artifacts that may be generated in a selected frequency range by some rain noise attenuators, an optional residual attenuator 106 (shown in FIG. 1) may also condition the voice signal before or after it is converted to the time domain. The residual attenuator 106 may track the power spectrum within a selected frequency range such as the mid to high frequency range (e.g., more than about 1000 Hz). When a large increase in signal power is detected an improvement may be obtained by limiting or dampening the transmitted power in that range to a predetermined or calculated threshold. A calculated threshold may be equal to, or based on, the average spectral power of that same frequency range at an earlier period in time.

Figure 6:
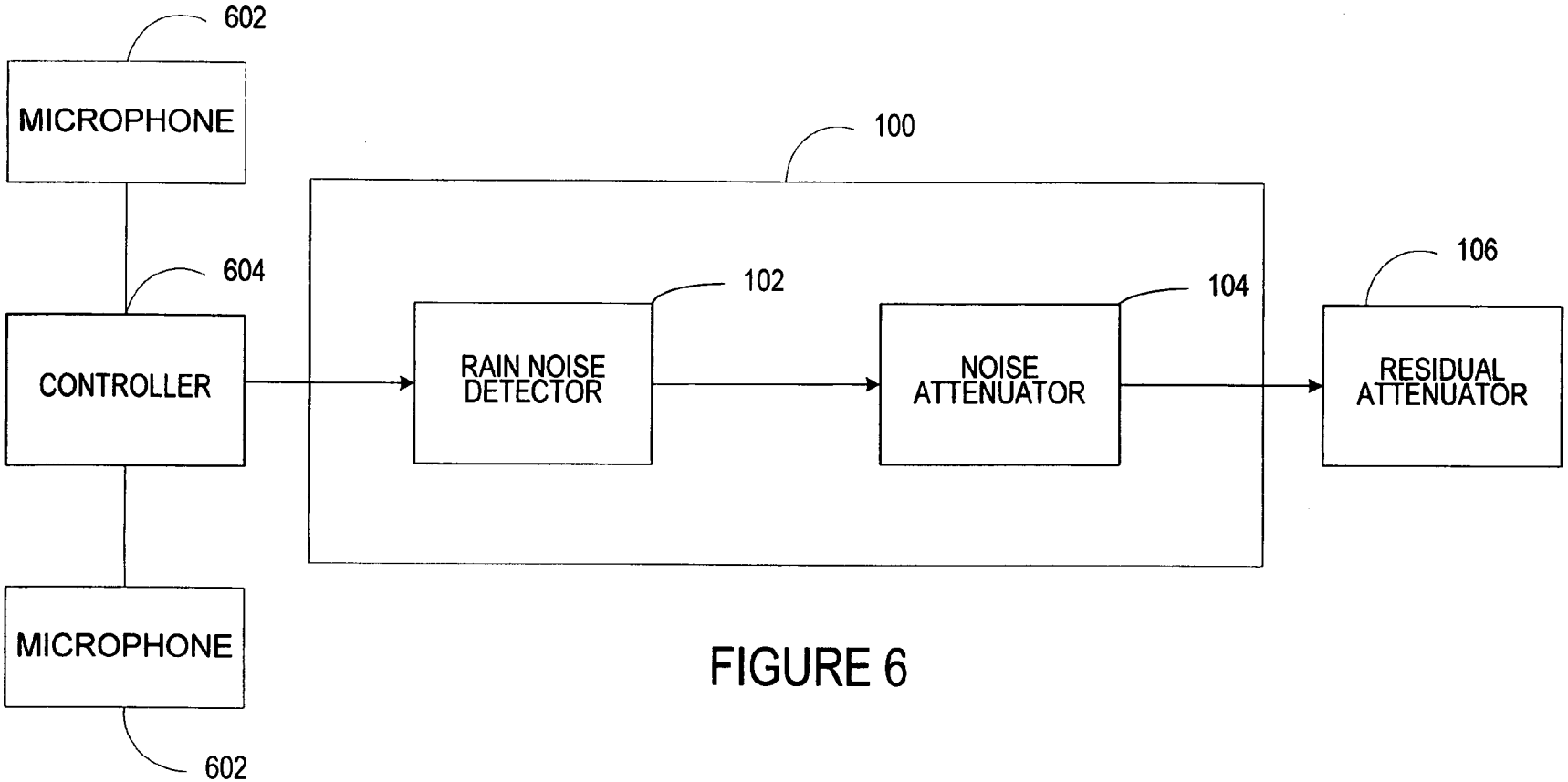
FIG. 6 is a pre-processing system coupled to the voice enhancement logic of FIG. 1.

Further improvements to voice quality may be achieved by pre-conditioning the input signal before the rain noise detector 102 processes it. One pre-processing system may exploit the lag time that a signal may arrive at different detectors that are positioned apart as shown in FIG. 6. If multiple detectors or microphones 602 are used that convert sound into an electric signal, the pre-processing system may include control logic 604 that automatically selects the microphone 602 and channel that senses the least amount of rain noise. When another microphone 602 is selected, the electric signal may be combined with the previously generated signal before being processed by the rain noise detector 102.

Figure 7:
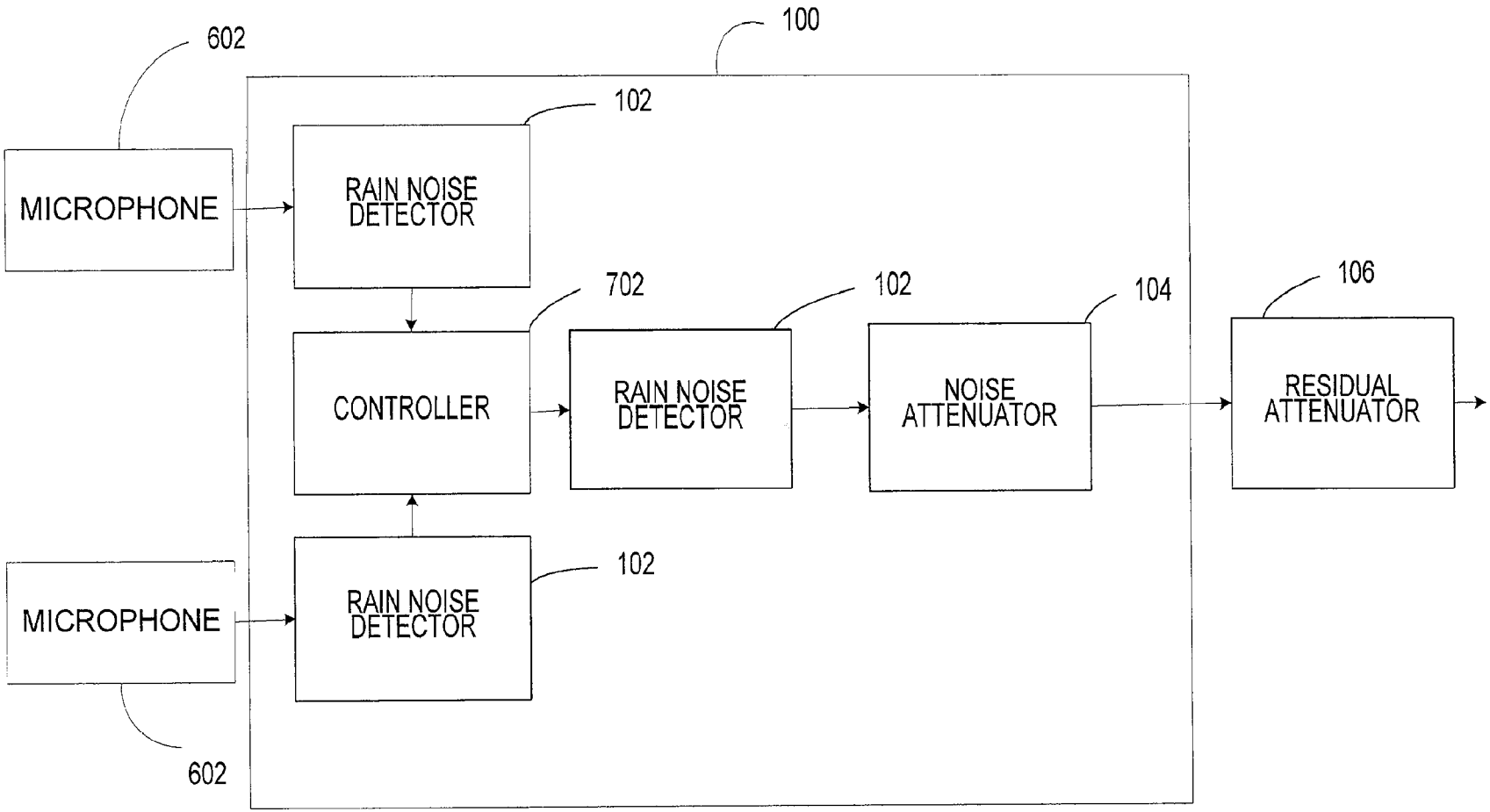
FIG. 7 is an alternative pre-processing system coupled to the voice enhancement logic of FIG. 1.

Alternatively, multiple rain noise detectors 102 may be used to analyze the input of each of the microphones 602 as shown in FIG. 7. Spectral rain noise estimates may be made on each of the channels. A mixing of one or more channels may occur by switching between the outputs of the microphones 602. The signals may be evaluated and selected on a frequency-by-frequency basis. Alternatively, control logic 702 may combine the output signals of multiple rain noise detectors 102 at a specific frequency or frequency range through a weighting function.

Figure 8:
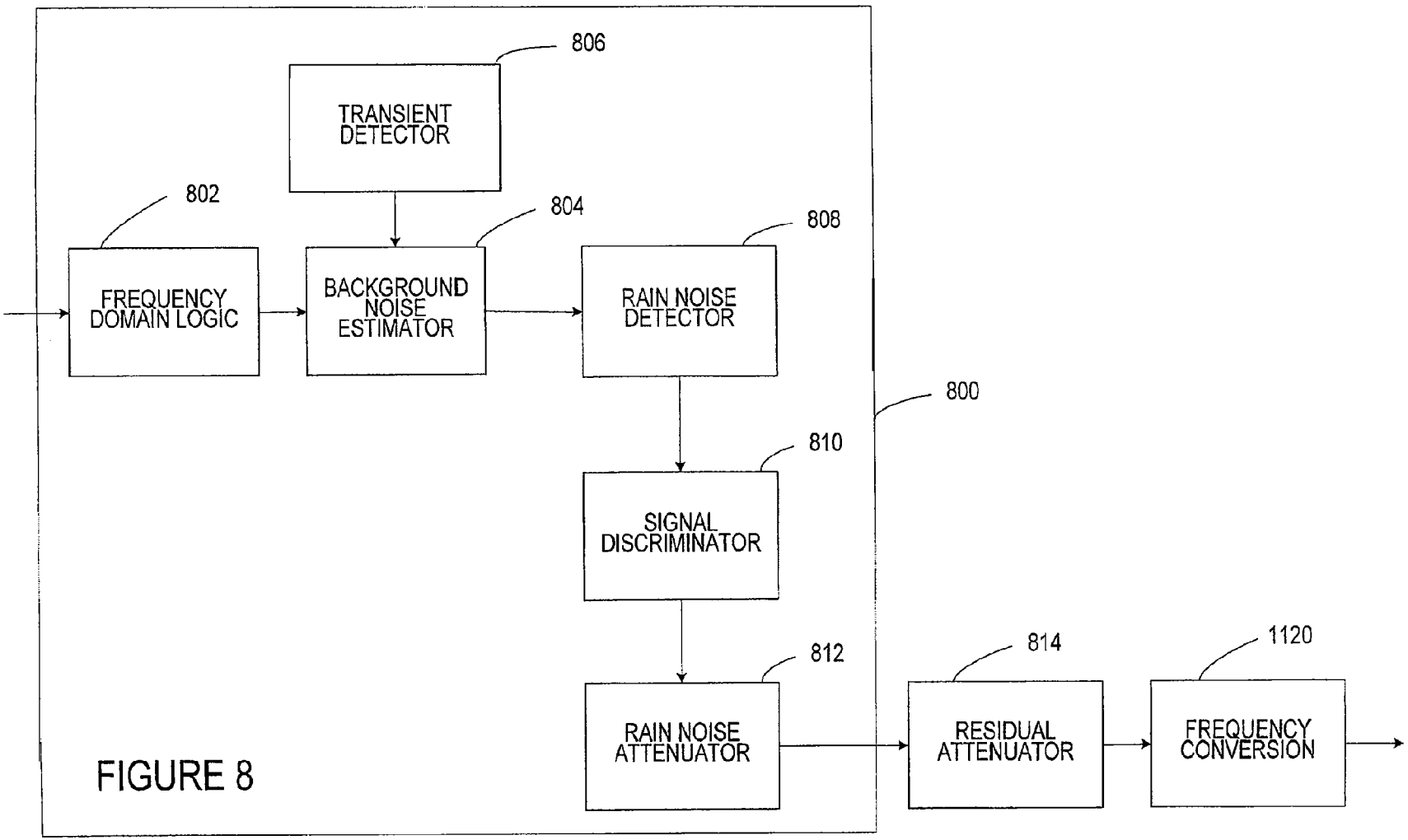
FIG. 8 is a block diagram of an alternative voice enhancement system.

FIG. 8 is alternative voice enhancement logic 800 that also improves the perceptual quality of a processed voice. The enhancement is accomplished by time-frequency transform logic 802 that digitizes and converts a time varying signal to the frequency domain. A background noise estimator 804 measures the continuous or ambient noise that occurs near a sound source or the receiver. The background noise estimator 804 may comprise a power detector that averages the acoustic power in each frequency bin. To prevent biased noise estimations at non-periodic transients, a transient detector 806 disables the noise estimation process during unexpected or unpredictable increases in power. In FIG. 8, the transient detector 806 may disable the background noise estimator 704 when an instantaneous background noise B(f, i) exceeds an average background noise $B(f)_{Ave}$ by more than a selected decibel level 'c.' This relationship may be expressed as:

$$B(f,i)>B(f)_{Ave}+c \quad \text{(Equation 1)}$$

To detect a rain event, a rain noise detector 708 may fit a line to a selected portion of the spectrum. Through a regression, a best-fit line may model the severity of the rain noise 202. To limit any masking of voice, the fitting of the line to a suspected range of rain noise may be constrained by the rules described above. A rain event may be identified when a high correlation between a fitted line and the noise associated with rain is detected. Whether or not a high correlation exists, may depend on a desired clarity of a processed voice and the variations in frequency and amplitude of the rain noise.

Alternatively, a rain event may be identified by the analysis of time varying spectral characteristics of the input signal that may be graphically displayed on a spectrogram. A spectrogram is a two dimensional pattern as shown in FIG. 3 in which the vertical dimensions correspond to frequency and the horizontal dimensions correspond to time.

A signal discriminator 810 may mark the voice and noise of the spectrum in real or delayed time. Any method may be used to distinguish voice from noise. In FIG. 7, voiced signals may be identified by (1) the narrow widths of their bands or peaks;

(2) the resonant structure that may be harmonically related; (3) the resonances or broad peaks that correspond to formant frequencies; (4) characteristics that change relatively slowly with time; (5) their durations; and when multiple detectors or microphones are used, (6) the correlation of the output signals of the detectors or microphones, and many other attributes and/or combinations.

To overcome the effects of rain noise, a rain noise attenuator 812 may dampen or substantially remove the rain noise from the noisy spectrum by any method. One method may add the periodic rain noise pulses to a recorded or modeled continuous noise. In the power spectrum, the modeled noise may then be removed from the unmodified spectrum by the means described above. If an underlying peak or valley 902 is masked by rain noise 202 as shown in FIG. 9 or masked by a continuous noise, a conventional or modified interpolation method may be used to reconstruct the peak and/or valley as shown in FIG. 10. A linear or step-wise interpolator may be used to reconstruct the missing part of the signal. A time series synthesizer may then be used to convert the signal power to the time domain, which provides a reconstructed voice signal.

To minimize the "musical noise," squeaks, squawks, chirps, clicks, drips, pops, tones, or other sound artifacts that may be generated in a selected frequency range by some rain noise attenuators, an optional residual attenuator 814 may also be used. The residual attenuator 814 may track the power spectrum within a frequency range. When a large increase in signal power is detected an improvement may be obtained by limiting the transmitted power in the frequency range to a predetermined or calculated threshold. A calculated threshold may be equal to or based on the average spectral power of that same frequency range at a period earlier or later in time.

Figure 11:
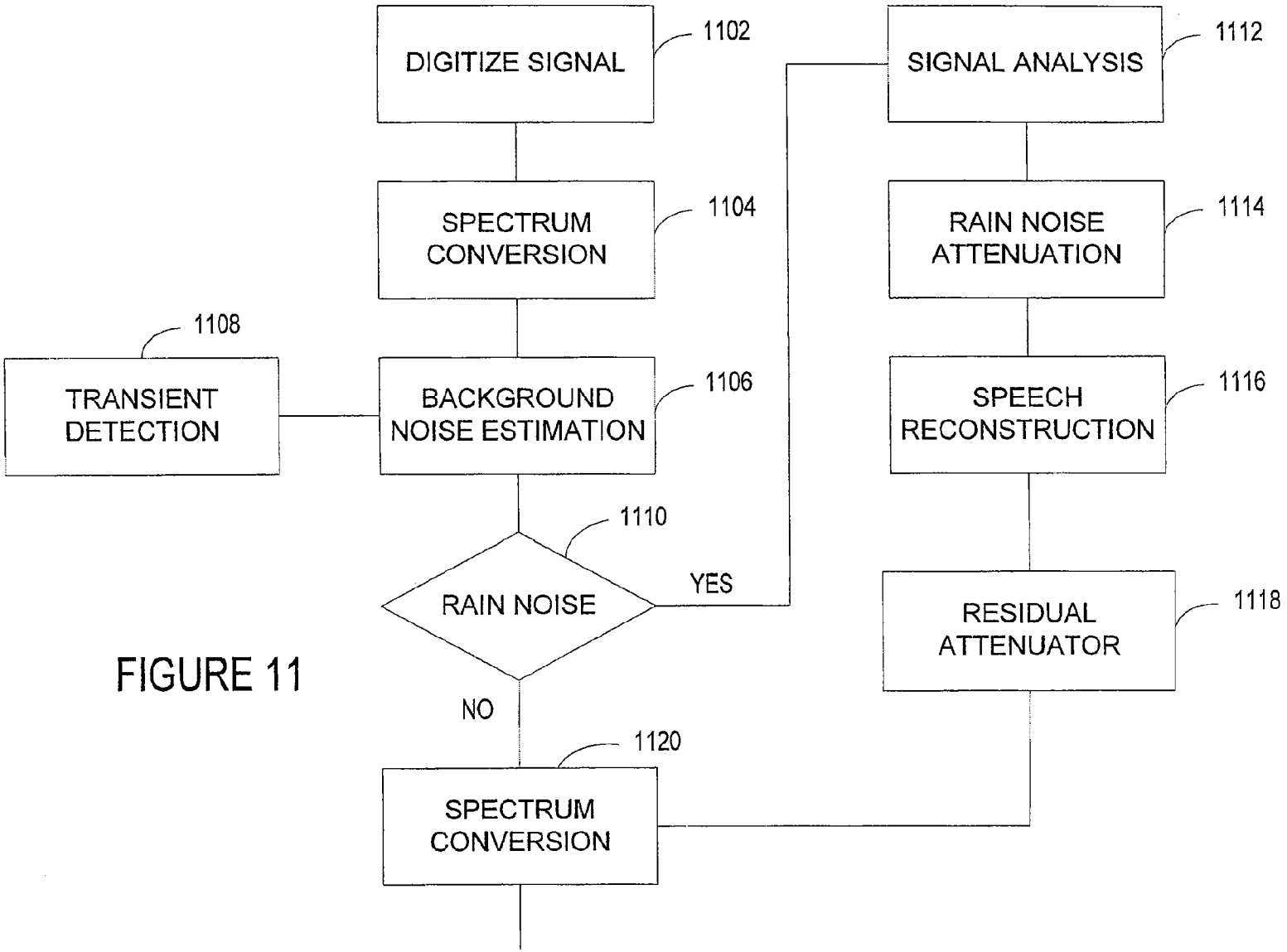
FIG. 11 is a flow diagram of a voice enhancement.

FIG. 11 is a flow diagram of a voice enhancement that removes some rain noise and continuous noise to enhance the perceptual quality of a processed voice. At act 1102 a received or detected signal is digitized at a predetermined frequency. To assure a good quality voice, the voice signal may be converted to a PCM signal by an ADC. At act 1104 a complex spectrum for the windowed signal may be obtained by means of an FFT or filter bank that separates the digitized signals into frequency bins, with each bin identifying an amplitude and a phase across a small frequency range.

At act 1106, a continuous or ambient noise is measured. The background noise estimate may comprise an average of the acoustic power in each frequency bin. To prevent biased noise estimations at transients, the noise estimation process may be disabled during abnormal or unpredictable increases in power at act 1108. The transient detection act 1108 disables the background noise estimate when an instantaneous background noise exceeds an average background noise by more than a predetermined decibel level.

At act 1110, a rain event may be detected when a high correlation exits between a best-fit line and a selected portion of the frequency spectrum. Alternatively, a rain event may be identified by the analysis of time varying spectral characteristics of the input signal. When a line fitting detection method is used, the fitting of the line to the suspected rain signal may be constrained by some optional acts. Exemplary optional acts may prevent a calculated offset, slope, or coordinate point in a rain noise model from exceeding an average value. Another optional act may prevent the rain noise detection method from applying a calculated rain noise correction when a vowel or another harmonic structure is detected. If a vowel or another harmonic structure is detected, the rain noise detection method may limit the rain noise correction to values less than or equal to predetermined or average values. An additional optional act may allow the average rain noise model or attributes to be updated only during unvoiced segments. If a voiced or mixed voice segment is detected, the average rain noise model or attributes are not updated under this act. If no voice is detected, the rain noise model or each attribute may be updated through many means, such as through a weighted average or a leaky integrator. Many other optional acts may also be applied to the model.

At act 1112, a signal analysis may discriminate or mark the voice signal from the noise-like segments. Voiced signals may be identified by any means including, for example, (1) the narrow widths of their bands or peaks; (2) the resonant structure that may be harmonically related; (3) their harmonics that correspond to formant frequencies; (4) characteristics that change relatively slowly with time; (5) their durations; and when multiple detectors or microphones are used, (6) the correlation of the output signals of the detectors or microphones.

To overcome the effects of rain noise, a rain noise is substantially removed or dampened from the noisy spectrum by any act. One exemplary act 1114 adds the substantially periodic rain pulses to a recorded or modeled continuous noise. In the power spectrum, the modeled noise may then be substantially removed from the unmodified spectrum by the methods and systems described above. If an underlying peak or valley 902 is masked by a rain event 202 as shown in FIG. 9 or masked by a continuous noise 902, a conventional or modified interpolation method may be used to reconstruct the peak and/or valley at act 1116. A time series synthesis may then be used to convert the signal power to the time domain at act 1120, which provides a reconstructed voice signal.

To minimize the "musical noise," squeaks, squawks, chirps, clicks, drips, pops, frequency tones, or other sound artifacts that may be generated in the selected frequency range by some rain noise removal processes, a residual attenuation method may also be performed before the signal is converted back to the time domain. An optional residual attenuation method 1118 may track the power spectrum within a frequency range. When a large increase in signal power is detected an improvement may be obtained by limiting the transmitted power in that frequency range to a predetermined or calculated threshold. A calculated threshold may be equal to or based on the average spectral power of that same frequency range at a period earlier or later in time.

The method shown in FIG. 11 may be encoded in a signal bearing medium, a computer readable medium such as a memory, programmed within a device such as one or more integrated circuits, or processed by a controller or a computer. If the methods are performed by software, the software may reside in a memory resident to or interfaced to the rain noise detector 102, noise attenuator 104, a communication interface, or any other type of non-volatile or volatile memory interfaced or resident to the voice enhancement logic 100 or 800. The memory may include an ordered listing of executable instructions for implementing logical functions. A logical function may be implemented through digital circuitry, through source code, through analog circuitry, or through an analog source such through an analog electrical, audio, or video signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or "signal-bearing medium" may comprise any means that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

From the foregoing descriptions it should be apparent that the above-described systems may also condition signals received from only one microphone or detector. It should also be apparent, that many combinations of systems may be used to identify and track rain events. Besides the fitting of a line to a suspected rain event, a system may (1) detect periodic peaks in the spectra having a SNR greater than a predetermined threshold; (2) identify the peaks having a width greater than a predetermined threshold; (3) identify peaks that lack a harmonic relationships; (4) compare peaks with previous voiced spectra; and (5) compare signals detected from different microphones before differentiating the rain noise segments, other noise like segments, and regular harmonic structures. One or more of the systems described above may also be used in alternative voice enhancement logic.

Other alternative voice enhancement systems include combinations of the structure and functions described above. These voice enhancement systems are formed from any combination of structure and function described above or illustrated within the attached figures. The logic may be implemented in software or hardware. The term "logic" is intended to broadly encompass a hardware device or circuit, software, or a combination. The hardware may include a processor or a controller having volatile and/or non-volatile memory and may also include interfaces between devices through wireless and/or hardwire mediums. The wireless interfaces may utilize Zigbee, Wi-Fi, WiMax, Mobile-Fi, Ultrawideband, Bluetooth, cellular and any other wireless technologies or combination.

Figure 12:
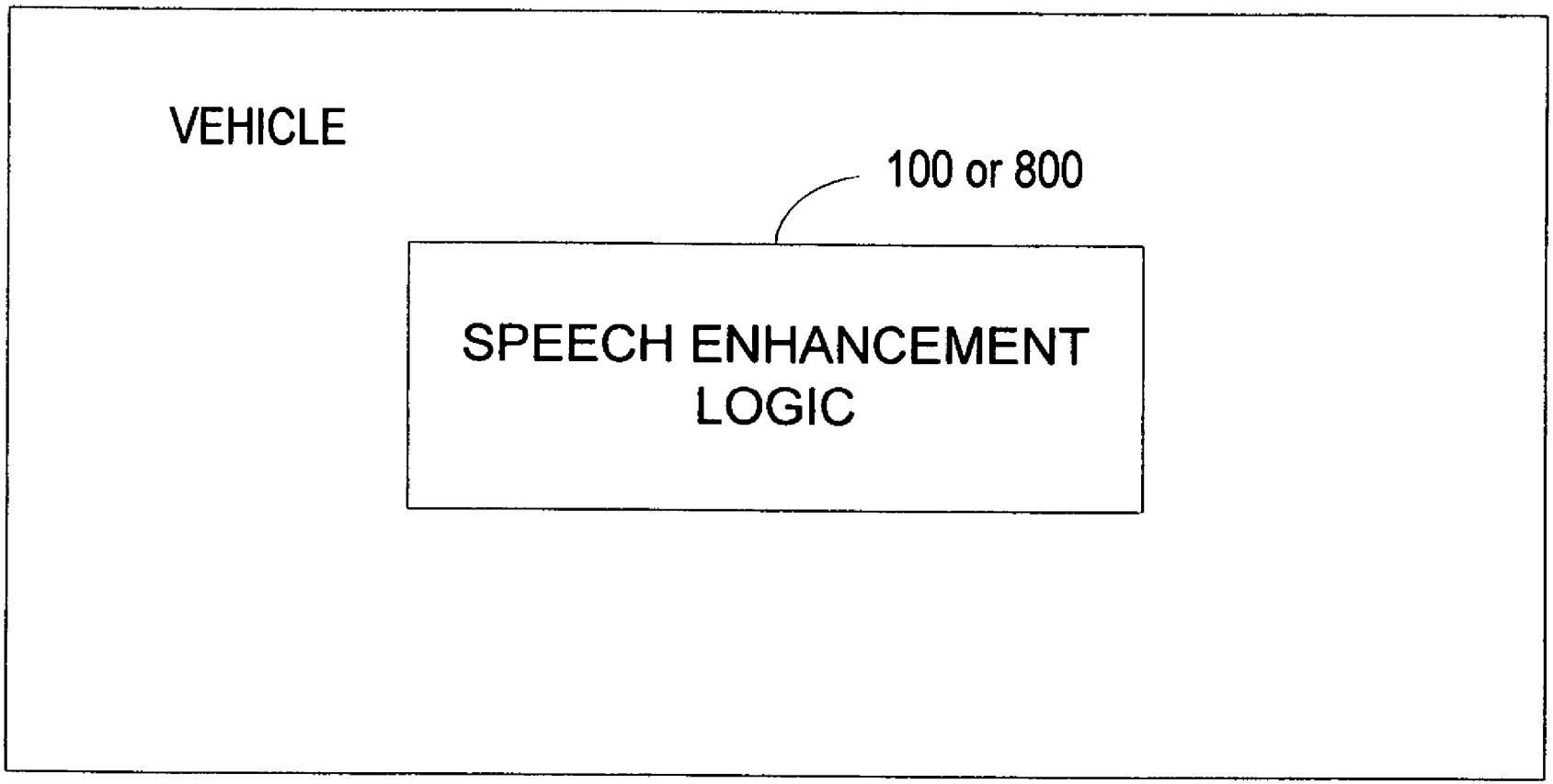
FIG. 12 is a block diagram of voice enhancement logic within a vehicle.
Figure 13:
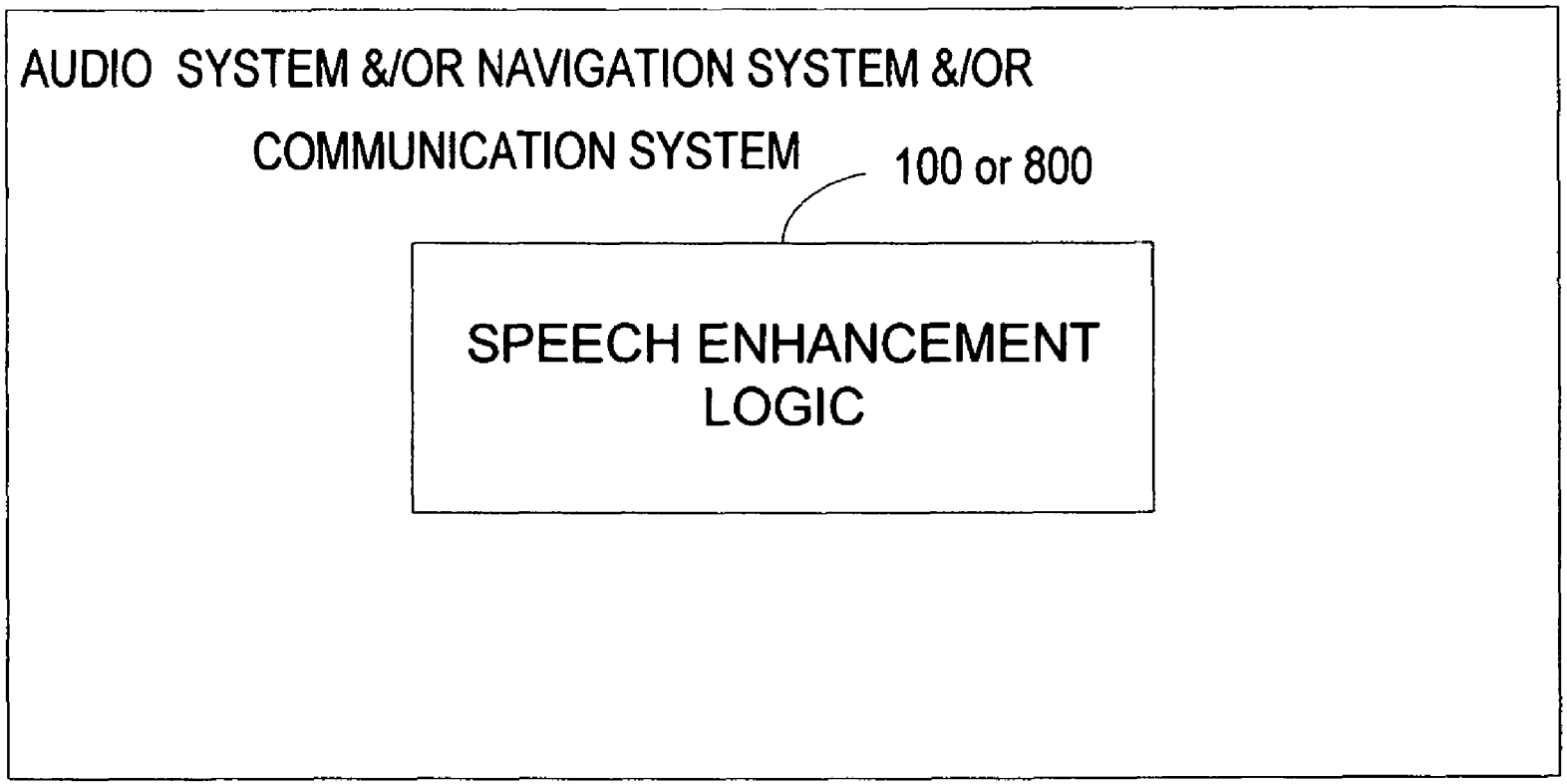
FIG. 13 is a block diagram of voice enhancement logic interfaced to an audio system and/or a navigation system and/or a communication system.
Figure 14:
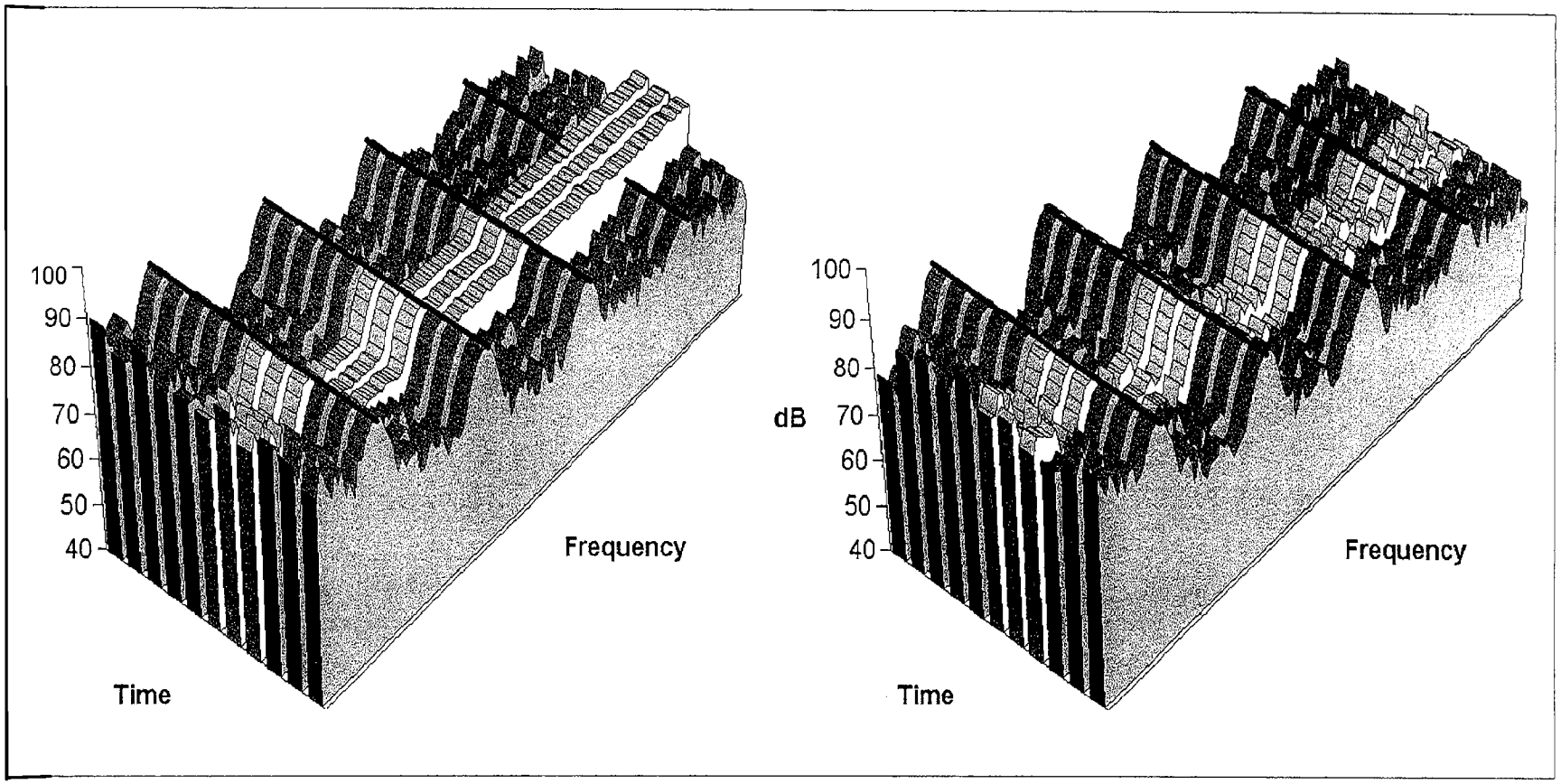
FIG. 14 are waterfall plots of simulated voice combined with noises of rain and other sources.

The voice enhancement logic is easily adaptable to any technology or devices. Some voice enhancement systems or components interface or couple devices or structures for transporting people or things such as the vehicle shown in FIG. 12. Some voice enhancement systems or components interface or couple instruments that convert voice and other sounds into a form that may be transmitted to remote locations, such as landline and wireless devices, audio equipment, navigation equipment as shown in FIG. 13, and other communication systems that may be susceptible to rain noise.

The voice enhancement logic improves the perceptual quality of a processed voice. The logic may automatically learn and encode the shape and form of the noise associated with the movement of water and/or the noise associated with water striking a surface in a real or a delayed time. By tracking substantially all or some of the selected attributes, the logic may eliminate, dampen, or reduce the water related noise using a memory that temporarily or permanently stores the attributes of that noise. The voice enhancement logic may also dampen a continuous noise and/or the squeaks, squawks, chirps, clicks, drips, pops, tones, or other sound artifacts that may be generated within some voice enhancement systems and may reconstruct voice when needed.

Figure 15:
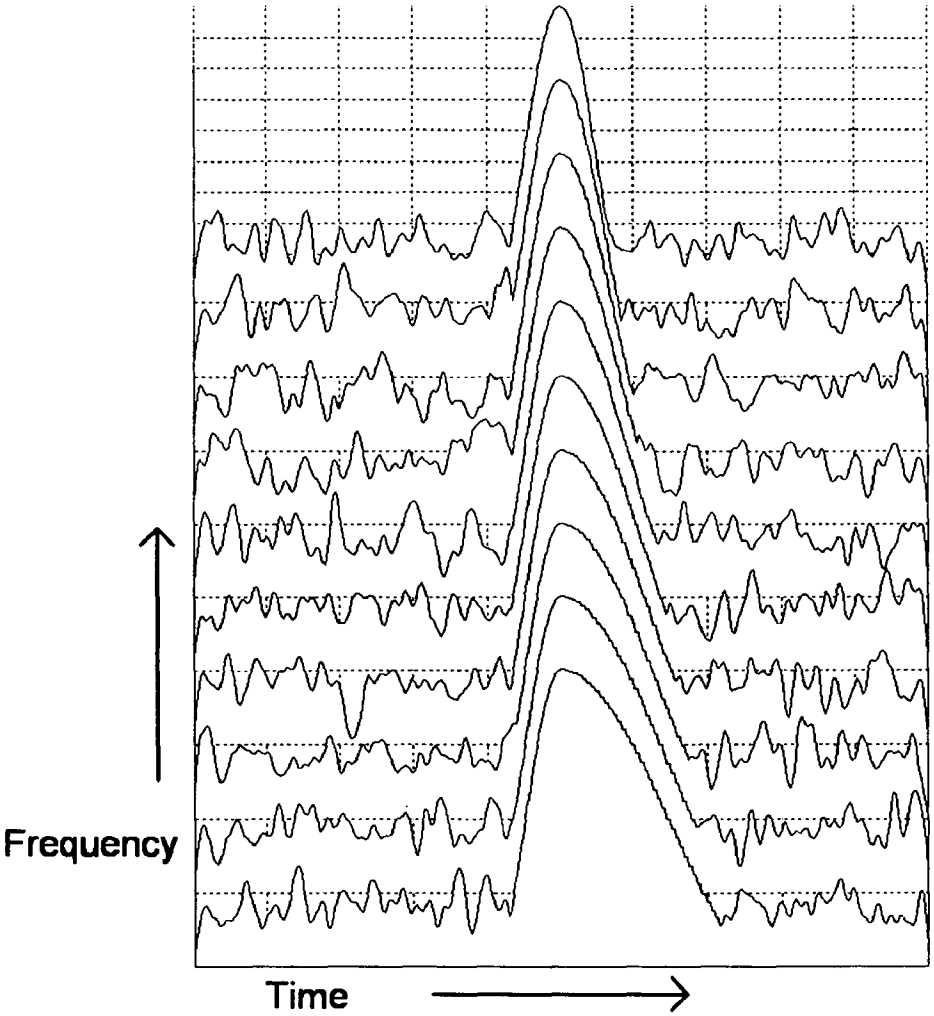
FIG. 15 is a simulated time-frequency plot showing a two-dimensional raindrop noise model.

Another alternate method of rain drop detection uses a two-dimensional model of rain drop intensity in both time and frequency. An example of a possible time-frequency model for rain drop detection is shown in FIG. 15. Because rain drop noise may be wide-band, substantially similar intensity-vs.-time profiles may be expected in the frequency ranges involved in the raindrop event. All frequencies involved in the rain may plot rise at approximately the same time, but may have different peak values, durations, and decay rates. The rain detector may also consider that part of the rain drop may be masked by louder sounds, such as voice harmonics, and may partially or fully exclude these frequency ranges from the rain model. This exclusion may be explicit, by scanning for probable non-rain features before modeling, or implicit, by choosing a modeling method that allows values to significantly exceed the selected model.

Detection may involve fitting a predefined rain model to the spectrum and determining the quality of the match, as well as possibly identifying which frequency ranges are involved in the rain drop event. The included frequency ranges may be continuous or discontinuous; in addition, all or part of the spectrum may be identified as being only partially involved in the raindrop event.

Some or all of the parameters used to model the rain drop noise may be constrained to be within predetermined and/or adaptive limits, which may be a function of frequency, presence of voice, characteristics of recently detected raindrops, average time between raindrops, or any other internal or external data which can be made available to the rain detector. In particular, these parameters may include rain drop duration, peak intensity, rise and fall rates, allowable intensity variation between different frequency ranges.

Because of the high intensity and short duration of a typical rain drop event, it may be desirable to attenuate or remove the raindrop before the entire event has been observed; furthermore, in a real-time setting there may be limited or no future information available. A further refinement of this rain detection method is a method for estimating the likelihood of a rapid rise being part of a raindrop and estimating the raindrop model parameters without complete future information. In this case, the rate of energy increase, and the range of frequencies involved in the increase, may be used as a primary detection method. The expected duration and rate of decay in the estimated model may be used at a nearby future time to verify that the detected raindrop continues to fit the estimated model. In order to minimize the unwanted attenuation of the speech signal, the rain noise attenuator may discontinue or reduce attenuation if the raindrop does not behave as predicted. Alternatively, when a noise estimate removal method is being used, the rain drop model may simply decay as predicted and allow the signal to pass through unattenuated once the model drops below the level of the rain noise estimate.

Figure 16:
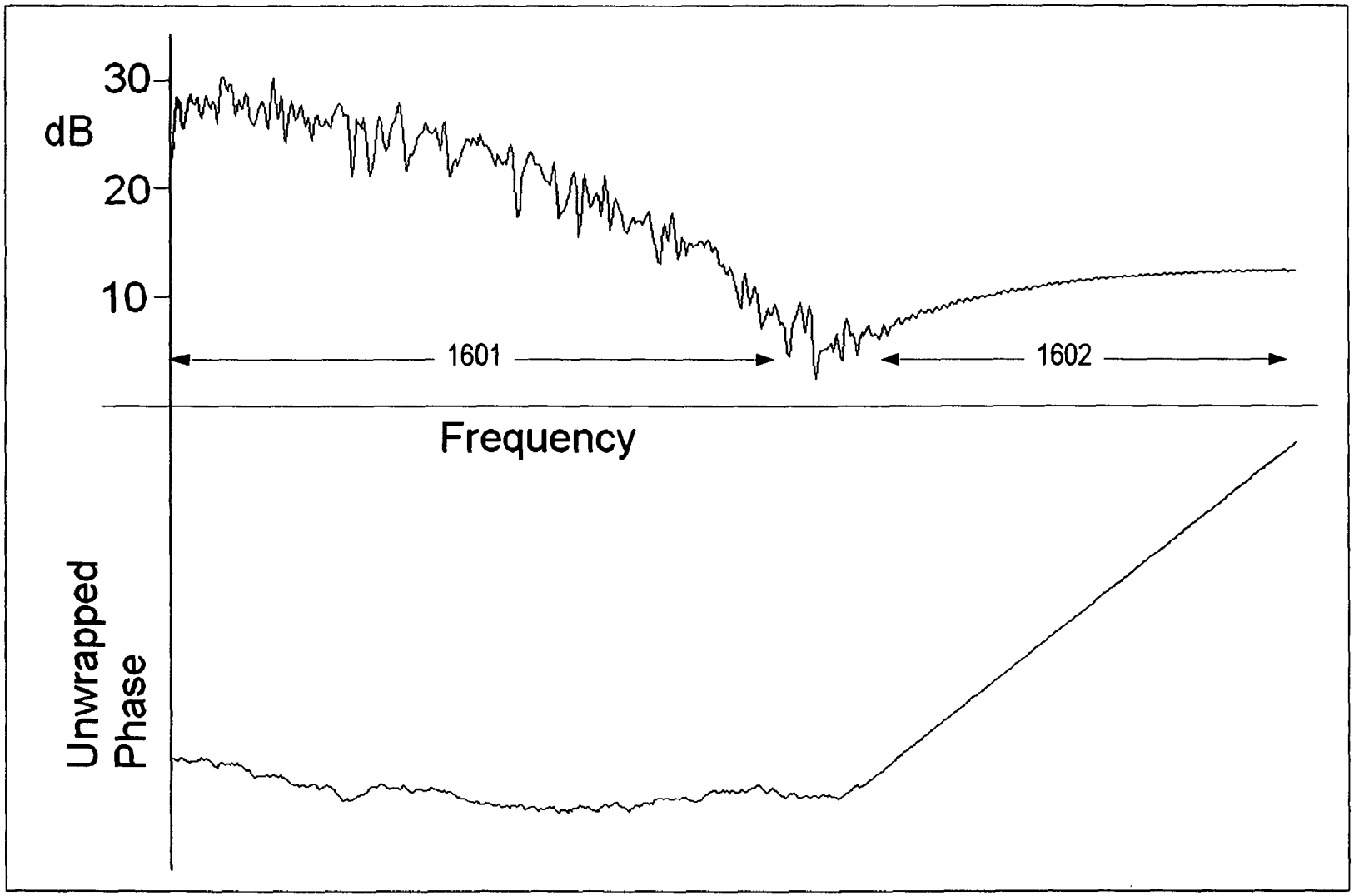
FIG. 16 is a combined frequency-magnitude and frequency-phase plot of a simulated frame containing raindrop noise.

A further refinement uses additional observed properties of raindrop spectra to assist the detector in distinguishing between rain and non-rain signals. One distinguishing feature of the rain drop noise may be the continuity of the magnitude and/or phase of its spectrum across many adjacent frequency bins. In FIG. 16, the portion of the spectrum dominated by rain noise 1602 has a significantly smoother magnitude plot than the portion dominated by other noise sources 1601.

Certain types of rain drop noise may have a significantly flatter and/or smoother magnitude than a spectrum containing voice or other speech sounds. One or more mathematical measures of a spectrum's flatness or smoothness may be used, on part or all of the spectrum, to improve the distinction between rain and voice spectra. This measure, which may be computed for the entire spectrum for predefined bands, or continuously using a sliding window across the entire spectrum, may be used to help decide whether a raindrop noise is present and how involved each frequency is in the raindrop.

An example of a smoothness measure is the sum of absolute differences algorithm, which computes the absolute value of the difference in magnitude or logarithmic magnitude between adjacent frequency bins, and summing this over a number of bins to produce a value that is generally small for smooth spectra and greater for spectra with large variations between the intensity of adjacent frequency bins. An example of a flatness measure is the Spectral Flatness Measure (SFM) which may be found by computing the ratio of the geometric mean of the magnitude spectrum to its arithmetic mean.

Phase continuity may also be used to distinguish rain drop noises from other sounds. The rain drop noise may be represented by a short high-energy burst in the time domain, and this may cause the unwrapped phases of the FFT result to be locally linear as illustrated in the phase plot in the portion of the spectrum dominated by rain noise 1602.

One method for determining the local linearity of phases is to take the absolute value of the second derivative of the unwrapped phase, then smoothing this in frequency. This measure may produce values close to zero for regions of the spectrum dominated by impulse-like noise and values significantly greater than zero in regions dominated by other types of sound, such as tonal sound or longer-duration noise. This measure may be used to assist with distinguishing transients such as rain drop noise from tonal or speech sounds.

In addition, the value of the slope in the linear part of the phase plot may be directly relatable to the position of the transient within the time-series signal, allowing a time-based detection or removal method to more precisely detect and/or remove the disturbance in the time domain.

The rain detection module may communicate with other devices in the vehicle to adjust the behavior of the rain detector and remover depending on the status of other systems in the vehicle (e.g. the windshield wiper controller). It may, for example, be desirable to enable the rain detection logic 102 only when the windshield wipers are switched on and/or to adjust the parameters of the rain drop model depending on the speed of the wipers. Conversely, the rain detector may transmit information about the intensity and average time between raindrop-like noises to the wiper controller, which may enhance its ability to intelligently control the wipers without driver intervention.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A system for attenuating rain noise, comprising:

a rain noise detector configured to analyze a frequency spectrum of an input signal to identify whether the input signal contains a rain noise, where the rain noise detector is configured to fit a model to a portion of the input signal and identify that a noise of the input signal is associated with rain based on a correlation between the model and the portion of the input signal; and a rain noise attenuator configured to remove at least a portion of the rain noise identified by the noise detector from the input signal to obtain an output sound signal with reduced rain noise content.

2. The system of claim 1, where the model comprises a best-fit regression line.

3. The system of claim 2, where the rain noise detector is configured to derive a correlation between the best-fit regression line and the portion of the input signal, and identify whether the input signal contains the rain noise based on the correlation.

4. The system of claim 1, where the rain noise detector is configured to separate a noise segment from a remaining portion of the input signal, and analyze the noise segment to detect an occurrence of rain noise.

5. The system of claim 1, where the rain noise detector is configured to model a spectrum of an identified rain noise, and retain the modeled spectrum of the identified rain noise in memory.

6. The system of claim 1, where the rain noise detector is configured to distinguish between rain and non-rain signal portions based on a continuity measurement of a magnitude or phase of the input signal across multiple frequency bins.

7. The system of claim 1, where the rain noise detector is configured to communicate with a windshield wiper controller of a vehicle, and where the rain noise detector is configured to enable rain noise detection analysis based on information from the windshield wiper controller regarding a state of windshield wipers of the vehicle.

8. The system of claim 1, where the rain noise detector is configured to identify the rain noise based on a rain drop model;

where the rain noise detector is configured to communicate with a windshield wiper controller of a vehicle, and where the rain noise detector is configured to adjust a parameter of the rain drop model based on information from the windshield wiper controller regarding a speed of windshield wipers of the vehicle.

9. The system of claim 1, where the rain noise detector is configured to communicate with a windshield wiper controller of a vehicle, where the rain noise detector is configured to calculate rain intensity or rain drop spacing information by analyzing sound content of the input signal, and where the rain noise detector is configured to transmit the rain intensity or rain drop spacing information to the windshield wiper controller.

10. A method of dampening rain noise, comprising:

fitting a model to a portion of an input signal;

identifying that a noise of the input signal is associated with rain based on a correlation between the model and the portion of the input signal; and dampening at least a portion of the noise associated with rain from the input signal to obtain an output sound signal with reduced rain noise content.

11. The method of claim 10, where the model comprises a best-fit regression line.

12. The method of claim 10, further comprising:

measuring a continuity of a magnitude or phase of the input signal across multiple frequency bins; and distinguishing between rain and non-rain signal portions based on the continuity measurement.

13. The method of claim 10, further comprising enabling rain noise detection analysis based on information received from a windshield wiper controller regarding a state of windshield wipers of the vehicle.

14. The method of claim 10, further comprising adjusting a parameter of a rain drop model based on information received from a windshield wiper controller regarding a speed of windshield wipers of the vehicle.

15. The method of claim 10, further comprising:

calculating rain intensity or rain drop spacing information by analyzing sound content of the input signal; and transmitting the rain intensity or rain drop spacing information to the windshield wiper controller.

16. The method of claim 10, where the act of identifying comprises identifying, by a processor, that the noise of the input signal is associated with rain.

17. A non-transitory computer-readable storage medium with executable instructions stored thereon, where the instructions are configured to cause a processor to perform the steps of:

fitting a model to a portion of an input signal;

identifying that a noise of the input signal is associated with rain based on a correlation between the model and the portion of the input signal; and dampening at least a portion of the noise associated with rain from the input signal to obtain an output sound signal with reduced rain noise content.

18. The non-transitory computer-readable storage medium of claim 17, where the model comprises a best-fit regression line.

19. The non-transitory computer-readable storage medium of claim 17, where the instructions are further configured to cause the processor to perform the steps of:

measuring a continuity of a magnitude or phase of the input signal across multiple frequency bins; and distinguishing between rain and non-rain signal portions based on the continuity measurement.

* * * * *